United States Patent [19]

Matui

[11] Patent Number: 4,752,800

[45] Date of Patent: Jun. 21, 1988

[54] RECORDING DEVICE SUCH AS ELECTRONIC BLACKBOARD

[75] Inventor: Hirotoshi Matui, Nara, Japan

[73] Assignee: Sharp Kabushiki Kaisha, Osaka, Japan

[21] Appl. No.: 72,876

[22] Filed: Jul. 14, 1987

[30] Foreign Application Priority Data

Jul. 19, 1986 [JP] Japan ..... 61-170175

[51] Int. Cl.[4] ..... G03G 15/00

[52] U.S. Cl. ..... 355/3 R; 355/3 BE; 355/5; 355/16; 355/19; 355/78

[58] Field of Search ..... 355/3 BE, 3 R, 19, 44, 355/78, 16, 5, 11

[56] References Cited

U.S. PATENT DOCUMENTS 4,167,326 9/1979 Payne ..... 355/16
4,174,175 11/1979 DiMaria ..... 355/44
4,387,984 6/1983 Sato ..... 355/19 X
4,569,581 2/1986 Sato ..... 355/3 BE
4,600,296 7/1986 Hage ..... 355/16
4,646,164 2/1987 Kishi ..... 355/5 X
4,687,318 8/1987 Shibasaki et al. ..... 355/5

*Primary Examiner*—A. C. Prescott
*Attorney, Agent, or Firm*—Flehr, Hohbach, Test, Albritton & Herbert

[57] ABSTRACT

A recording device such as an electronic blackboard has a transparent and flexible drawing sheet in an endless form which stretches around a pair of parallel rollers and on which characters and figures can be erasably drawn. A uniformly charged photosensitive sheet is disposed behind this stretched drawing sheet and light is made incident thereon through the drawing sheet such that a latent image is formed on the photosensitive sheet corresponding to the characters and figures on the drawing sheet. A printed copy of this latent image is obtained by the known electrophotographic technique.

8 Claims, 1 Drawing Sheet

RECORDING DEVICE SUCH AS ELECTRONIC BLACKBOARD

BACKGROUND OF THE INVENTION

This invention relates to a recording device such as a so-called electronic blackboard. Recording devices like an electronic blackboard have been known. With such a device, the user draws characters and figures on a white sheet-like member by using a pen, for example, and such characters and figures are subsequently exposed to light. The reflected light from the sheet-like member is passed through an optical system including a lens and is received, for example, by a solid image accepting unit. Output signals from such a unit are stored in memory buffer in the form, for example, of a random-access memory (RAM) and are used for thermal recording through electric circuits of various types. With electronic blackboards of conventional types, only so-called thermal recording paper sheets can be used for thermal recording and this has a limiting effect on the multi-purpose characteristics regarding recording medium. Moreover, accuracy of displayed characters and figures by thermal recording on a recording sheet is determined by the number of heat-emitting elements in the recorder, or the so-called thermal head, with which recording is effected on a thermal recording sheet as well as the size of the individual heat-emitting elements. If it is desired to improve the accuracy and quality of a display, therefore, an increased number of smaller heat-emitting elements must be used. This will cause the device to become complicated in structure. Furthermore, prior art technologies of this type required complicated processing of digital signals.

SUMMARY OF THE INVENTION

It is therefore an object of the present invention in view of the above to provide a recording device of the type referred to as an electronic blackboard, which has a such simplified structure and substantially improved operability. A recording device embodying the present invention, which achieves the above and other objects, is comprised of an endless sheet-like member which is light-transmissive and flexible and on which characters and figures can be drawn, a pair of rollers which are rotatable around mutually parallel axes and around which the aforementioned endless sheet-like member is stretched, a photosensitive sheet-like member which is disposed behind the stretched sheet-like member and is adapted to form an electrostatic latent image thereupon by exposure of light and a light source which is disposed on the opposite side of the photosensitive sheet-like member with respect to the endless sheet-like member and is adapted to irradiate the endless sheet-like members such that an optical image is formed on the photosensitive sheet-like member by the transmitted light, and that the electrostatic latent image on the photosensitive sheet-like member is used to record this image on a recording paper sheet. The user of a device of the present invention thus structured draws characters and figures on the endless sheet-like member which is both transparent and flexible. Since this endless sheet-like member is stretched around a pair of rollers which are rotatably supported around mutually parallel axes, the area on the endless sheet-like member where the characters and the figures have been drawn is transported in a specified direction when these rollers are rotated and approaches the photosensitive sheet-like member disposed behind this endless sheet-like member. The light source disposed on the opposite side of the photosensitive sheet-like member with respect to the endless sheet-like member serves to irradiate the endless sheet-like member, thereby forming on the photosensitive sheet-like member an optical image of the characters and figures which have been drawn. An electrostatic latent image is thus formed on the photosensitive sheet-like member according to the aforementioned optical image formed by the transmitted light and this latent image is used to record the optical image on a recording paper sheet.

BRIEF DESCRIPTION OF THE DRAWINGS

The accompanying drawings, which are incorporated in and form a part of the specifications, illustrate an embodiment of the present invention and, together, with the description, serve to explain the principals of the invention. In the drawings.

DETAILED DESCRIPTION OF THE INVENTION

Figure 1:
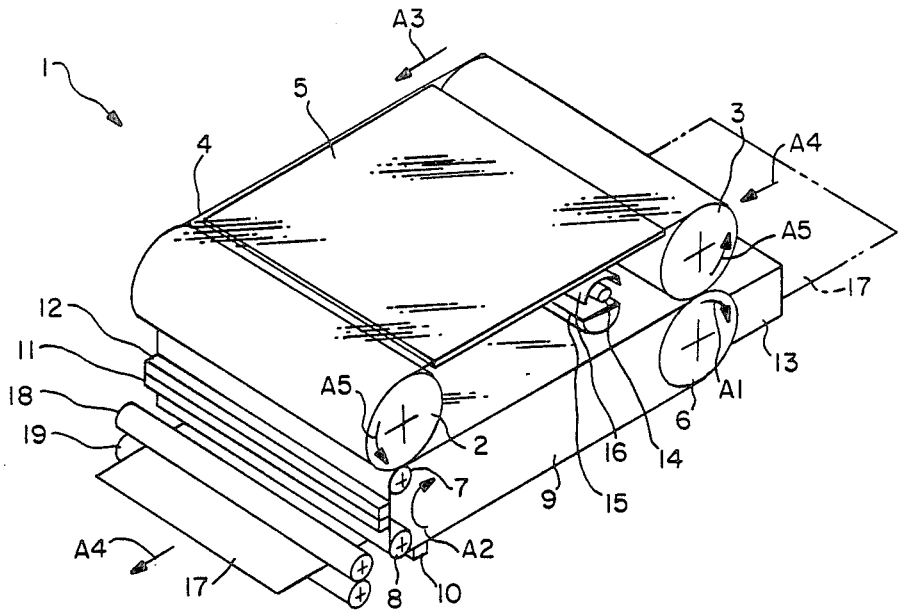
FIG. 1 is a schematic diagonal view of a recording device embodying the present invention.

With reference to FIG. 1, an electronic blackboard 1 embodying the present invention is shown with a pair of traveling rollers 2 and 3 which are adapted to rotate in the same direction around mutually parallel axes and a drawing sheet 4 in the form of a light-transmissive, flexible, endless sheet-like member, for example, of a polyethylene film stretched around these traveling rollers 2 and 3. This drawing sheet 4 is adapted for drawing characters and figures thereon from above (with respect to FIG. 1) by means, for example, of a water-based drawing pen (not shown). In order to make it easier to draw on this sheet, a white, hard base plate 5 is provided on the backside of (below with respect to FIG. 1) the part of the drawing sheet 4 facing upward.

Below the drawing sheet 4 and the traveling rollers 2 and 3 (with respect to FIG. 1), there is a driving drum 6 having an axis which is parallel to the axes of the traveling rollers 2 and 3 and comprising an aluminum member in the form of a cylinder. Numerals 7 and 8 indicate guide rollers. The driving drum 6 is rotated in the direction of the arrow A1 by a driving means such as a stepping motor as will be explained more in detail below, and is in linear contact with the traveling roller 3. The guide roller 7 is similarly in linear contact with the traveling roller 2 which is driven to rotate around its own axis.

The driving drum 6 and the guide rollers 7 and 8 support an endless photosensitive sheet 9 which is stretched therearound and is adapted to travel in the direction of the arrow A2. This photosensitive sheet 9 is made, for example, of an organic semiconductor material. Near the photosensitive sheet 9, there are a transfer charger 10 for a corona discharge, an erasing charger 11 and a primary charger 12, disposed in this order in the direction of the arrow A2 on the upstream side of the traveling roller 2. A developing tank 13 containing toner of the kind used with ordinary electrostatic copiers is disposed on the downstream side of the traveling roller 3 with respect to the arrow A2 and on the upstream side of the transfer charger 10.

Between the two traveling rollers 2 and 3 and on the opposite side of the photosensitve sheet 9 with respect to the drawing sheet 4, there is a light source 14 which may be a halogen lamp or a fluorescent lamp, extended, for example, in a perpendicular direction to the direction of travel of the drawing sheet 4 shown by the arrow A3 and spanning at least its entire width. Near the light source 14 and on the side of the photosensitive sheet 9 is a converging lens 15 facing the drawing sheet 4. There is provided a reflector plate 16 along the entire length of the light source 14 on the opposite side of the converging lens 15 with respect to the light source 14. A sheet of recording paper 17 is transported to the transfer charger 10 in the direction shown by the arrow A4 and is sandwiched between a pair of fixing rollers 18 and 19 disposed on the downstream side of the transfer charger 10 along the direction of the arrow A4 to have an image thereon fixed and to be discharged. Each of the fixing rollers 18 and 19 is comprised of an aluminum cylinder containing therein a heating means such as a halogen lamp and its external surface is coated with silicon resin or teflon resin.

Figure 2:
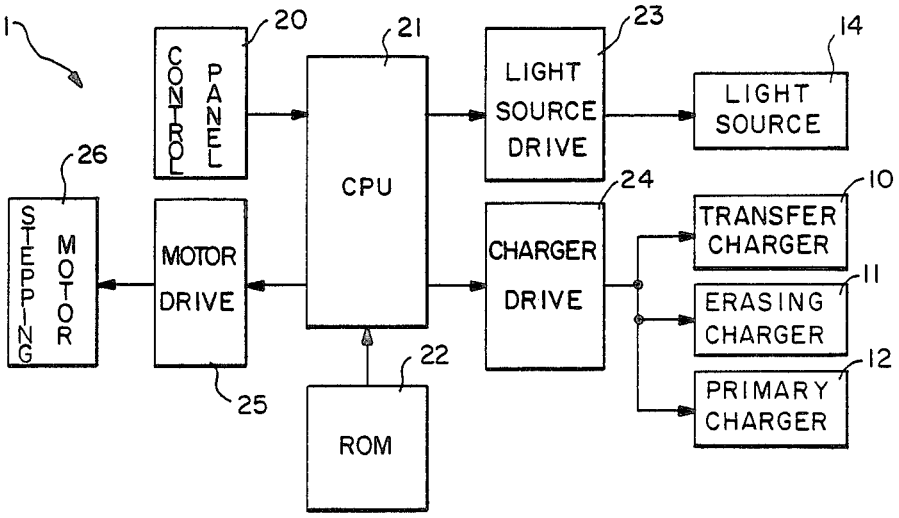
FIG. 2 is a block diagram showing the electrical structure of an electronic blackboard embodying the present invention.

The electrical structure of the electronic blackboard 1 is explained next with reference to FIG. 2. Numeral 20 indicates a control panel from which the motion of the drawing sheet 4, for example, may be controlled. Signals from the control panel 20 are received by a central processing unit CPU 21, programs for which are stored, for example, in a read-only memory ROM 22. This CPU 21 is connected to a light source driving circuit 23, a charger control circuit 24 and a motor driving circuit 25, these circuits being adapted to control the light source 14, the chargers, 11 and 12 and the motion of the stepping motor 26 or the like which drives the traveling rollers 2 and 3, the driving drum 6 etc.

A method of using the electronic blackboard 1 described above by way of FIGS. 1 and 2 is explained next. After a user uses a water-based drawing pen or the like to draw characters and figures on the part of the drawing sheet 4 supported from the back side by the base plate 5, a print command is issued from the control panel 20 to the CPU 21 if it is desired to record the characters and figures thus drawn on the drawing sheet 4. Thereupon, the CPU 21 activates the motor driving circuit 25 to drive the stepping motor 26 such that the traveling rollers 2 and 3 and the driving drum 6 are rotated in the directions respectively of the arrows A5 and A1. This causes the drawing sheet 4 to travel in the direction of the arrow A3. The drawing sheet 4 and the photosensitive sheet 9 may be designed to travel in the direction of the arrows A3 and A2, respectively, at the same speed. When the drawing sheet 4 carrying thereon the drawn characters and figures passes the traveling roller 2 along the arrow A3, it then comes into contact with the photosensitive sheet 9 and begins to travel with it in the same direction. The portion of the photosensitive sheet 9 which thus comes into contact with the drawing sheet 4 is uniformly charged electrostatically by means of the primary charger 12.

When the part of the drawing sheet 4 carrying the characters and figures drawn thereon reaches the neighborhood of the light source 14, the light source driving circuit 23 is activated and the light from the source 14 is made incident on the drawing sheet 4 by means of the converging lens 15. Such exposure to light is continued until the part of the drawing sheet 4 carrying characters and figures drawn thereon completely passes by the light source 14.

In the meantime, the uniformly charged photosensitive sheet 9 is also exposed to the light from the source 14, and the static electricity on the surface becomes thereby discharged except at the positions covered by the characters and figures drawn on the drawing sheet 4 which is in contract therewith. An electrostatic latent image is thus formed on the photosensitive sheet 9.

The photosensitive sheet 9 is then transported in the direction of the arrow A2 to the developing tank 13 and toner charged by friction, for example, becomes attached to the areas on its surface where a static electricity still remains as explained above. The photosensitive sheet 9 with toner thus attached on its surface is transported frther in the direction of the arrow A2 and the transfer charger 10 causes the toner to be electrostatically attracted onto a recording sheet 17 transported in the direction of the arrow A4. Thereafter, the toner electrostatically attracted to the recording sheet 17 is heated and fixed by means of the fixing rollers 18 and 19. As a result, the characters and figures drawn on the drawing sheet 4 are recorded on the recording sheet 17. In the meantime, the electrostatic charge remaining on the photosensitive sheet 9 from which the toner has been attracted away onto the recording sheet 17, is completely removed by means of the erasing charger 11. If necessary, the photosensitive sheet 9 is charged again by means of the primary charger 12. The characters and figures drawn on the drawing sheet 4 can be erased whenever the user so wishes.

With an electronic blackboard of the present invention, in summary, characters and figures drawn on the drawing sheet 4 can be recored on a recording sheet by a well-known method of electrophotography. As a result, there is no need, as described above, to use a recording sheet of any special characteristics such as a thermal recording sheet, and recording can be effected on a sheet of practically any kind. The multi-purpose characteristic of the recording sheet is thus improved and the operatability of the electronic blackboard is significantly improved. Moreover, no complicated processing such as digital processing is necessary for characters and figures drawn on the drawing sheet 4 because the conventional digital processing is replaced by analog processing by light on the photosensitive sheet 9. As a result, the recording device of the present invention is much simplified.

Since the original drawing on the drawing sheet 4 is drawn with a water-based drawing pen, the characters and the figures thus drawn can be erased easily and the same drawing sheet 4 can be used repeatedly. Since the drawing sheet is in an endless form, the characters and figures drawn immediately before need not be erased, and drawing and printing can be effected as one continuous job. It now goes without saying that the present invention can be applied not only to electronic blackboards but also, for example, to overhead projectors and the like.

The foregoing description of a preferred embodiment of the invention is being presented for purposes of illustration and description. It is not intended to be exhaustive or to limit the invention to the precise form disclosed. Any modifications and variations that may be apparent to a person skilled in the art are intended to be included within the scope of this invention.

What is claimed is:

1. A recording device comprising a drawing sheet which is transparent, flexible and in an endless form, and allows drawing thereon, a set of drawing sheet rollers rotatable around mutually parallel axes, said drawing sheet being stretched therearound, a photosensitive sheet disposed behind said stretched drawing sheet and allowing an electrostatic image to be formed thereon by exposure to light, a light source disposed on the opposite side of said photosensitive sheet with respect to said drawing sheet and serving to send light onto said drawing sheet and to thereby form an optical image on said photosensitive sheet by transmitted light, and recording means for printing said electrostatic image on recording paper.

2. The recording device of claim 1 wherein said drawing sheet is a polyethylene film.

3. The recording device of claim 1 wherein said drawing sheet is adapted to move around said rollers by the rotation of said rollers.

4. The recording device of claim 1 wherein said photosensitive sheet is also in an endless form and stretched around a second set of rollers which are rotatable parallel to set drawing sheet rollers.

5. The recording device of claim 4 wherein said photosensitive sheet is adapted to move around said second set of rollers by the rotation thereof.

6. The recording device of claim 5 wherein one of said drawing sheet rollers and one of said second set of rollers are in linearly contacting relationship, sandwiching said drawing sheet and said photosensitive sheet therebetween, and another of said drawing sheet rollers and another of said second set of rollers are in linearly contacting relationship, sandwiching said drawing sheet and said photosensitive sheet therebetween.

7. The recording device of claim 3 wherein said drawing sheet and said photosensitive sheet are adapted to move in contact with each other near said light source.

8. The recording device of claim 1 wherein said recording means include a primary charger for uniformly charging at least a portion of said photosensitive sheet, a developing device for forming a toner image on said photosensitive sheet, and a transfer charger for transferring said toner image from said photosensitive sheet to said recording paper.

* * * * *